US006666716B2

(12) United States Patent
Chien-Chung

(10) Patent No.: US 6,666,716 B2
(45) Date of Patent: Dec. 23, 2003

(54) TERMINAL STRUCTURE AND STACKED AUDIO JACK CONNECTOR PROVIDED THEREWITH

(76) Inventor: Lin Chien-Chung, 3F, No. 3, Lane 32, Kuo Feng Chi St., Taoyuan City (TW)

( * ) Notice: Subject to any disclaimer, the term of this patent is extended or adjusted under 35 U.S.C. 154(b) by 0 days.

(21) Appl. No.: 10/141,125

(22) Filed: May 9, 2002

(65) Prior Publication Data

US 2003/0211776 A1 Nov. 13, 2003

(51) Int. Cl.[7] ..... H01R 13/60
(52) U.S. Cl. ..... 439/541.5; 439/101; 439/79
(58) Field of Search ..... 439/541.5, 79, 439/188, 620, 101, 108, 607

(56) References Cited

U.S. PATENT DOCUMENTS 5,643,008 A * 7/1997 Tan et al. ..... 439/541.5
6,168,462 B1 * 1/2001 Liao ..... 439/541.5
6,234,834 B1 * 5/2001 Tsai et al. ..... 439/541.5
6,508,665 B1 * 1/2003 Yeh ..... 439/541.5

* cited by examiner

*Primary Examiner*—Hien Vu
(74) *Attorney, Agent, or Firm*—Rosenberg, Klein & Lee

(57) ABSTRACT

The present invention provides an terminal structure of an erect type stacked audio jack connector. The audio jack connector has at least two connector's main bodies. A first and a second signal terminal sets are disposed in each connector's main body. The first signal terminal set includes two first L-shaped terminals. A support portion is extended from one of the first L-shaped terminals. A bent elastic portion is extended from the support portion. A contact portion is extended from the elastic portion. A limit portion is extended from the other first L-shaped terminal. Similarly, the second signal terminal set includes two second L-shaped terminals. A support portion is extended from one of the second L-shaped terminals. A bent elastic portion is extended from the support portion. A contact portion is extended from the elastic portion. A limit portion is extended from the other second L-shaped terminal.

7 Claims, 5 Drawing Sheets

TERMINAL STRUCTURE AND STACKED AUDIO JACK CONNECTOR PROVIDED THEREWITH

FIELD OF THE INVENTION

The present invention relates to a terminal structure for a stacked audio jack connector and, more particularly, to a terminal structure for an audio jack connector, which is formed by stacking and fixedly joining at least two connector main bodies.

BACKGROUND OF THE INVENTION

Along with continual development of various kinds of electronic products and multimedia techniques, audio jack connectors have been widely applied in various kinds of industries. Stacked audio jack connectors are utilized for expansion of peripherals in various kinds of electronic products.

As shown in FIGS. 1 and 2, a prior art stacked audio jack connector is formed by stacking and fixedly joining a plurality of connector main bodies 1*a*. A hollow cylindrical plug portion 10*a* projects from the front side face of each of the connector main bodies 1*a*. The hollow part of the plug portion 10*a* forms a circular plug hole 11*a*, which is extended to the inside of the connector main body 1*a* for insertion of an audio jack connector (not shown). Additionally, five transversely arranged trench grooves 12*a* are formed in each connector main body 1*a*. A middle one of the trench grooves 12*a* is used for insertion of a ground terminal 13*a*, which is plugged therein, against a rear side of the connector main body 1*a*. The trench grooves 12*a* at the left and right sides of the middle trench groove 12*a* are used respectively for insertion of a first signal terminal set 14*a* and a second signal terminal set 15*a*. Both the first and second signal terminal sets 14*a* and 15*a* comprise two L-shaped terminals 16*a* and an elastic clamping piece 17*a* clamped at front end portions of the two L-shaped terminals 16*a*. A contact portion 18*a* is formed on the elastic clamping piece 17*a* to contact an inserted audio jack connector (not shown).

Because the elastic clamping pieces 17*a* and the L-shaped terminals 16*a* of the above first and second signal terminal sets 14*a* and 15*a* are separately formed and then assembled together, additional complicated manufacturing procedures are required. Moreover, when the elastic clamping piece 17*a* is clamped on the two L-shaped terminals 16*a*, complete planar contact cannot be assured between them, potentially affecting signal transmission through the connector. Furthermore, the terminal structure assembled in this way cannot be easily reduced in size, making it difficult to realize the compactness required in many applications.

Accordingly, the above terminal structure of a stacked audio jack connector has drawbacks and presents inconveniences in practical use. The present invention aims to provide a terminal structure of a stacked audio jack connector to overcome the problems in the prior art.

SUMMARY OF THE INVENTION

The primary object of the present invention is to provide a terminal structure of a stacked audio jack connector. The terminal structure is integrally formed to be secure in structure, so as to exhibit good rigidity and better contact conductivity, and to reduce the impedance generated when plugging with an audio jack connector. Moreover, the terminal structure can maintain good contact and will not be dislodged even when subjected to great vibration.

To achieve the above objects, the present invention provides a terminal structure of a stacked audio jack connector.

The audio jack connector has at least two connector main bodies. Preferably, at least five trench grooves are formed in each of the connector bodies. A middle trench groove is used to receive a ground terminal, which engages the rear side of the connector main body. The other four trench grooves at the left and right sides of the middle trench groove in the connector main body are used for insertion of a first signal terminal set and a second signal terminal set. In accordance with the present invention, the integration of the first and second signal terminal sets is improved. The first signal terminal set comprises two first L-shaped terminals arranged side by side, which are inserted into two adjacent trench grooves of the connector main body. A support portion is extended from the front end portion of one of the first L-shaped terminals. A bent elastic portion is extended from the support portion. A contact portion is further extended from the elastic portion. A limit portion configured to engage the transition between the elastic portion and the contact portion is formed at the front end portion of the other first L-shaped terminal. Similarly, the second signal terminal set comprises two second L-shaped terminals arranged side by side, which are inserted into two other adjacent trench grooves of the connector main body. A support portion is extended from the front end portion of one of the second L-shaped terminals. A bent elastic portion is extended from the support portion. A contact portion is further extended from the elastic portion. A limit portion configured to engage the transition between the elastic portion and the contact portion is formed at the front end portion of the other second L-shaped terminal.

The various objects and advantages of the present invention will be more readily understood from the following detailed description when read in conjunction with the appended drawings, in which:

DETAILED DESCRIPTION OF THE PREFERRED EMBODIMENTS

Figure 1:
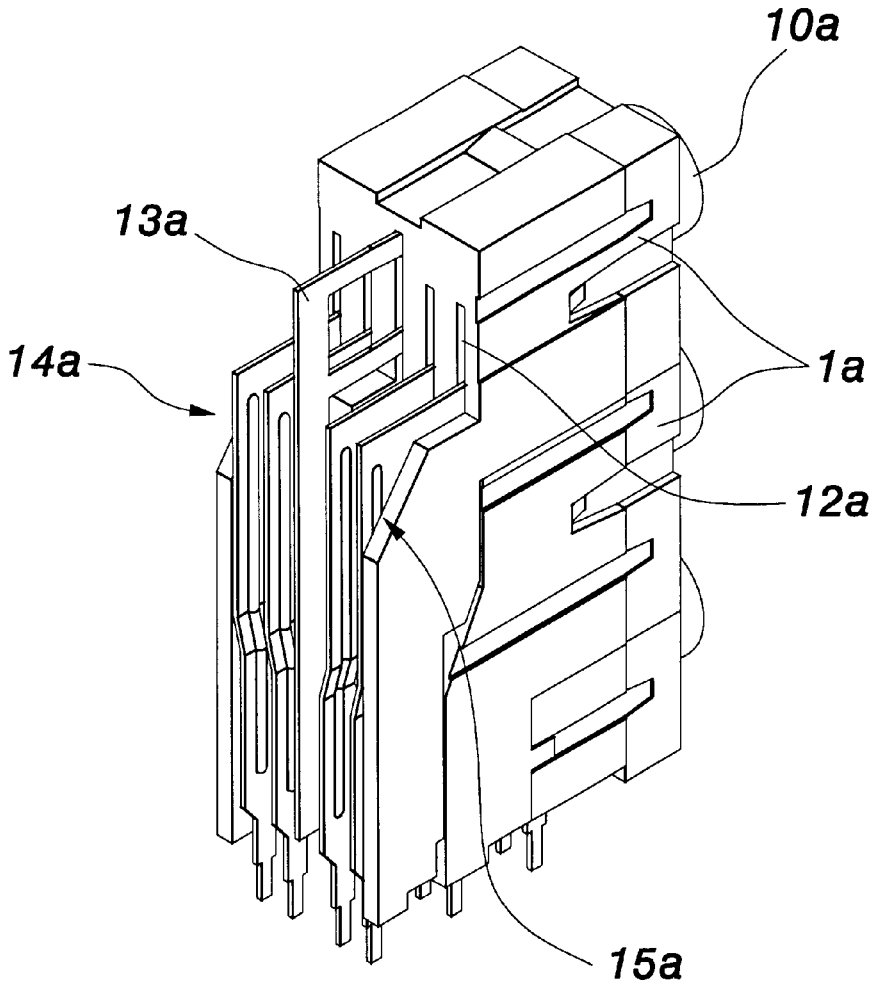
FIG. 1 PRIOR ART
FIG. 1 is perspective view of a prior art stacked audio jack connector.
Figure 2:
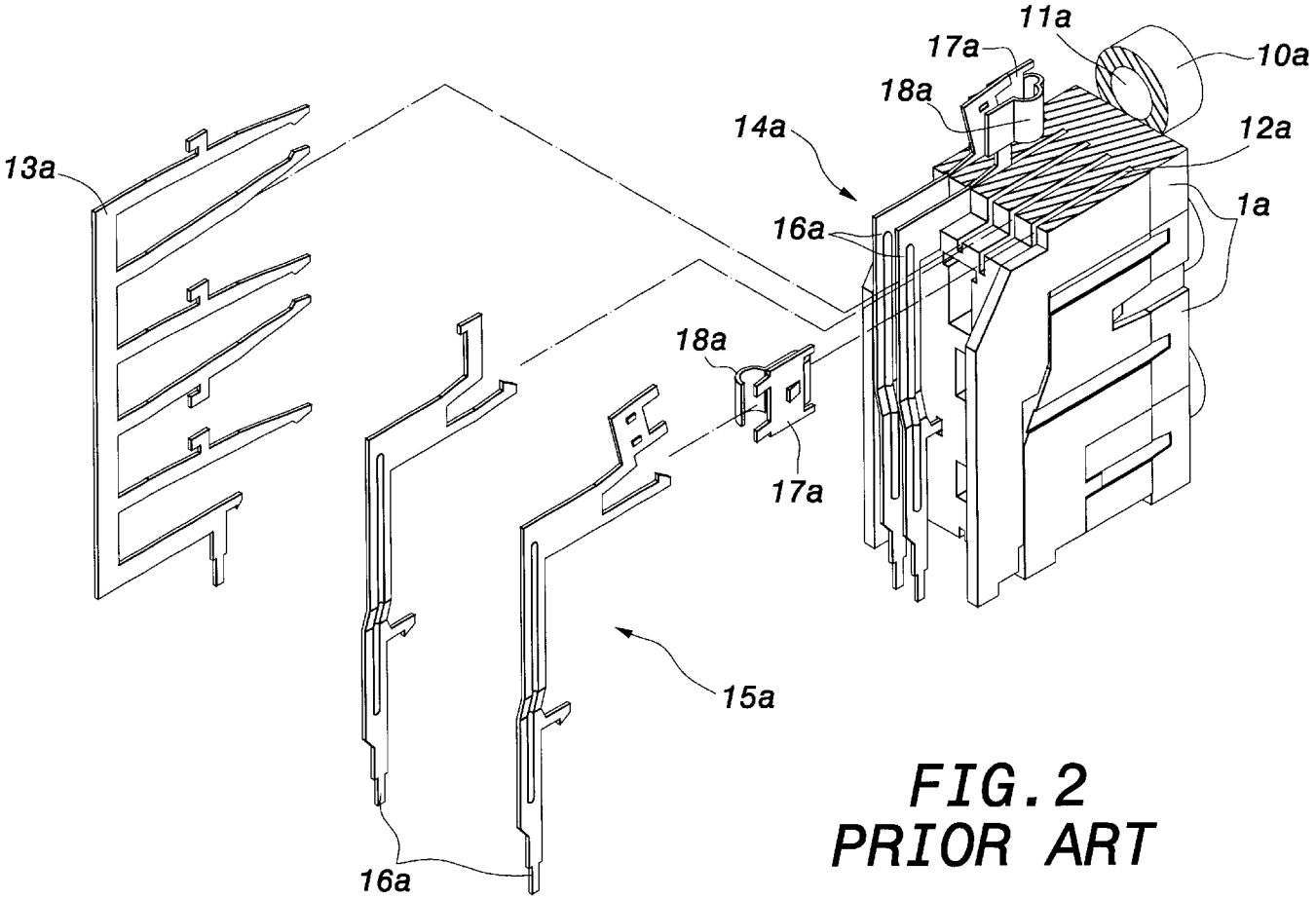
FIG. 2 PRIOR ART
FIG. 2 is a partial exploded perspective view of a prior art stacked audio jack connector.
Figure 3:
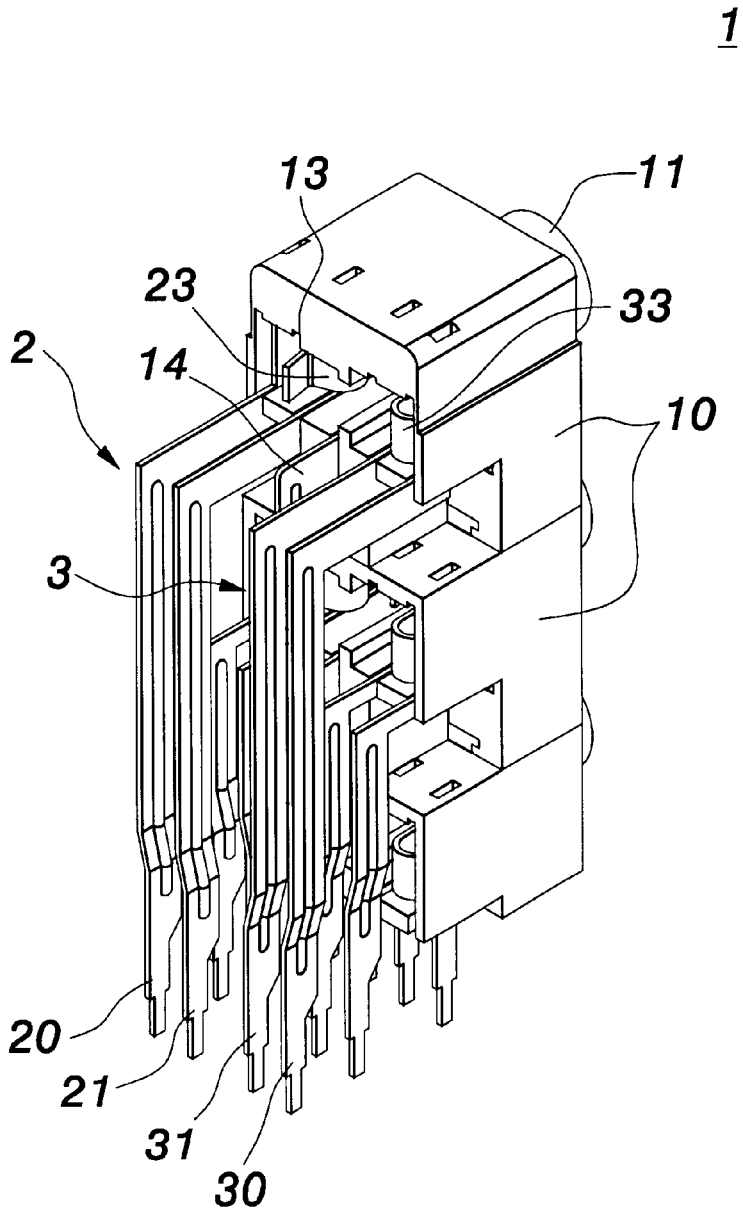
FIG. 3 is a perspective view of one embodiment of the present invention.
Figure 4:
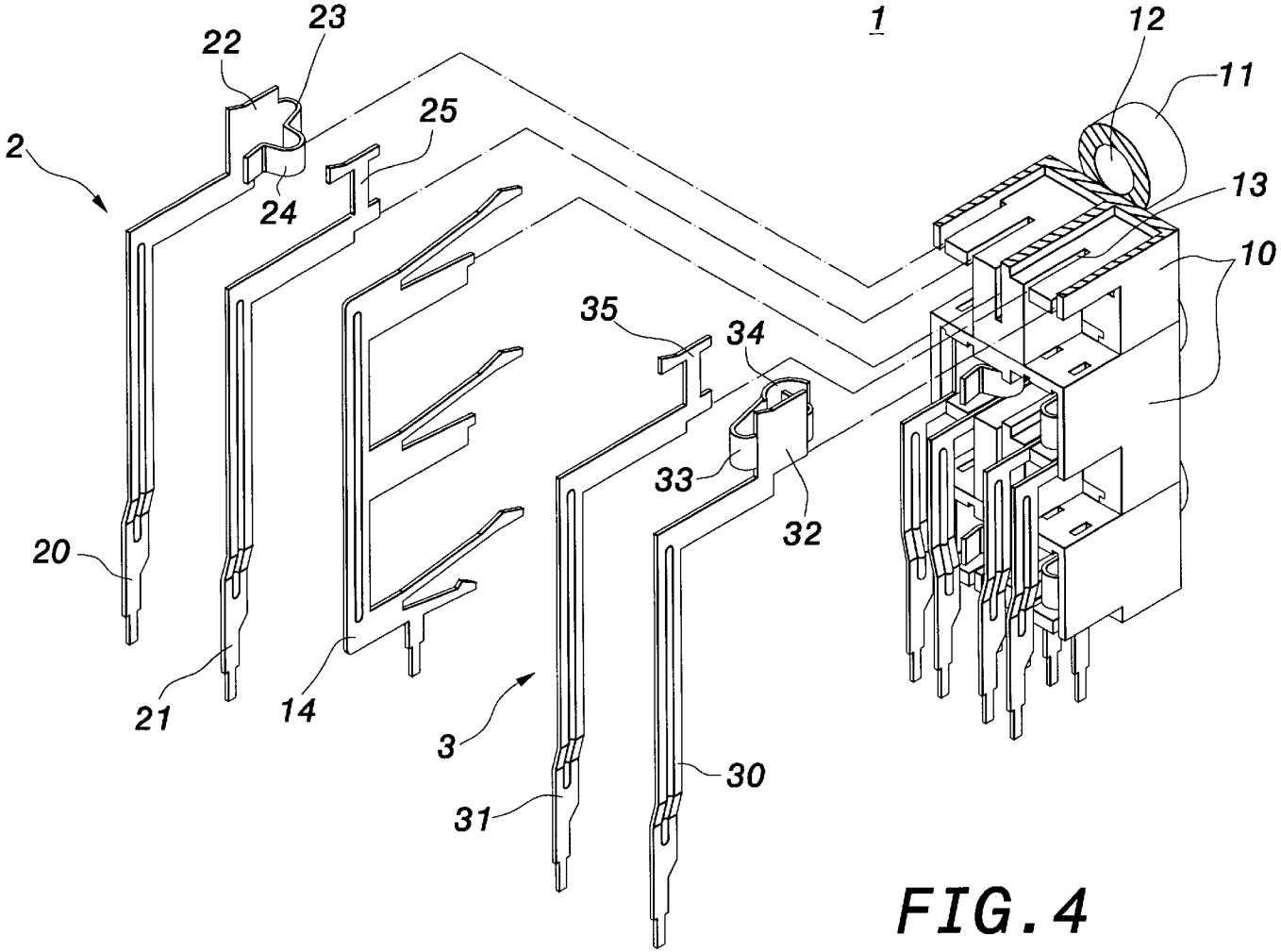
FIG. 4 is a partial exploded perspective view of one embodiment of the present invention.
Figure 5:
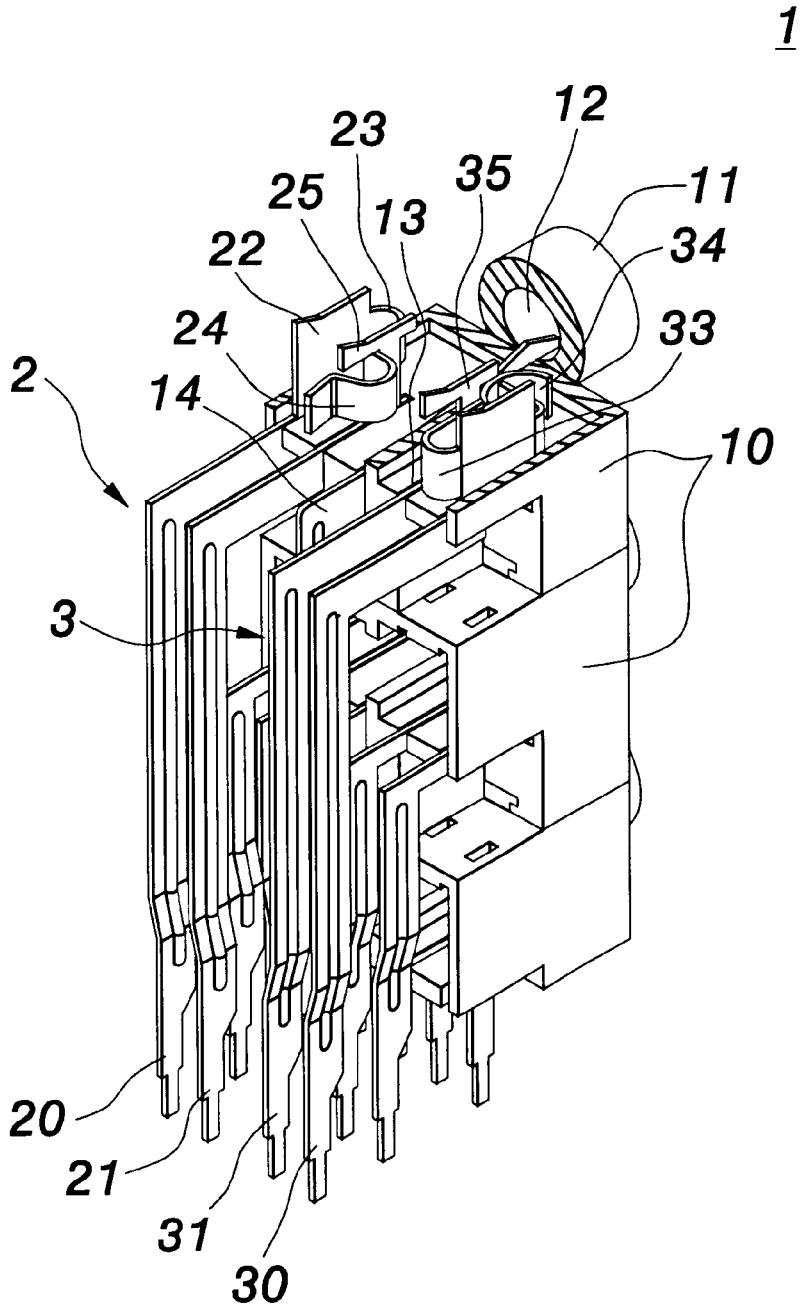
FIG. 5 is a partial perspective view of one embodiment of the present invention.

As shown in FIGS. 3, 4, and 5, the present invention provides a terminal structure of a stacked audio jack connector. The terminal structure applies to an audio jack connector 1 formed by stacking and fixedly joining at least two connector main bodies 10. A hollow cylindrical plug portion 11 projects from the front side of each of the connector main bodies 10 of the audio jack connector 1. The hollow part of the plug portion 11 forms a circular plug hole 12, which extends to the connector main body for insertion of an audio jack connector (not shown).

A plurality of transversely arranged trench grooves 13 are formed in each of the connector main bodies 10. A middle one of the trench grooves 13 receives a ground terminal 14, which engages the rear sides of the connector main bodies 10. The other trench grooves 13 at left and right sides of the middle trench groove in each of the connector main bodies 10 are used respectively for insertion of a first signal terminal set 2 and a second signal terminal set 3.

In accordance with the present invention, the integration of the first and second terminal sets 2 and 3 is improved.

The first signal terminal set 2 comprises two first L-shaped terminals 20 and 21 arranged side by side, which are inserted into two adjacent trench grooves 13 of the connector main body 10 at one side relative to the middle trench groove. A square support portion 22 is extended from a front end portion of one of the first L-shaped terminals 20. An elastic portion 23 bent toward the ground terminal 14 extends from a front edge of the support portion 22. The distal end of the elastic portion 23 forms a contact portion 24 to contact an inserted audio jack connector (not shown). An I-shaped limit portion 25 configured to engage the transition between the elastic portion 23 and the contact portion 24 extends upwards from a front end portion of the other first L-shaped terminal 21.

Similarly, the second signal terminal set 3 comprises two second L-shaped terminals 30 and 31 arranged side by side, which are inserted into two adjacent trench grooves 13 of the connector main body 10 at another side relative to the middle trench groove. A square support portion 32 is extended from a front end portion of one of the second L-shaped terminals 30. An elastic portion 33 bent toward the ground terminal 14 extends from a rear edge of the support portion 32. The distal end of the elastic portion 33 forms a contact portion 34 to contact an inserted audio jack connector (not shown). An I-shaped limit portion 35 configured to engage the transition between the elastic portion 33 and the contact portion 34 extends upwards from a front end portion of the other second L-shaped terminal 31.

In the terminal structure of a stacked audio jack connector of the present invention, because the first and second L-shaped terminals 20 and 30 are integrally formed, respectively, with the support portions 22 and 32, the elastic portions 23 and 33, and the contact portions 24 and 34, the terminal structure of the audio jack connector 1 is secure in structure and has good rigidity and better contact conductivity. Accordingly, the impedance generated upon plugging with an audio jack connector (not shown) is reduced. Moreover, the terminal structure maintains good contact and will not be dislodged even when subjected to great vibration.

Although the present invention has been described with reference to the preferred embodiment thereof, it will be understood that the invention is not limited to the details thereof. Various substitutions and modifications have been suggested in the foregoing description, and others will occur to those of ordinary skill in the art. Therefore, all such substitutions and modifications are intended to be embraced within the scope of the invention as defined in the appended claims.

I claim:

1. A terminal structure for a connector body comprising:

at least one corresponding pair of L-shaped terminals;

a first of said corresponding pair of L-shaped terminals having an integrally formed section including:

a front end portion and a support portion extending upward therefrom; a contact portion disposed in spaced manner from said support portion; and, an elastic portion integrally joined to said support and contact portions to extend in bent manner therebetween;

a second of said corresponding pair of L-shaped terminals having an L-shaped limit portion extending upward from a front end portion thereof, said limit portion abutting said first of said pair of L-shaped terminals susbtantially at a boundary between the integral joint of said elastic and contact portions.

2. The terminal structure as recited in claim 1 wherein said contact portion defines in contour a bulbous protrusion integrally joining said elastic portion at a base, said limit portion engaging said first of said pair of L-shaped terminals at said base of said bulbous protrusion.

3. The terminal structure as recited in claim 1 wherein each said L-shaped terminal is integrally formed.

4. A stacked audio jack connector for receiving a plurality of signal contacts comprising:

a plurality of stacked main bodies each having a plug hole for receiving one of the signal contacts, at least one of said stacked main bodies having formed therein a plurality of trench grooves;

a grounding terminal engaging an intermediate one of said trench grooves; and, at least one corresponding pair of L-shaped terminals engaging an adjacent pair of said trench grooves offset from said intermediate trench groove;

a first of said corresponding pair of L-shaped terminals having an integrally formed section including:

a front end portion and a support portion extending upward therefrom; a contact portion disposed in spaced manner from said support portion; and, an elastic portion integrally joined to said support and contact portions to extend in bent manner therebetween;

a second of said corresponding pair of L-shaped terminals having an L-shaped limit portion extending upward from a front end portion thereof, said limit portion abutting said first of said pair of L-shaped terminals substantially at a boundary between the integral joint of said elastic and contact portions.

5. The stacked audio jack connector as recited in claim 4 wherein said contact portion defines in contour a bulbous protrusion integrally joining said elastic portion at a base, said limit portion engaging said first of said pair of L-shaped terminals at said base of said bulbous protrusion.

6. The stacked audio jack connector as recited in claim 4 wherein said elastic portion of said first of said pair of L-shaped terminals extends from said support portion towards said grounding terminal.

7. The stacked audio jack connector as recited in claim 4 wherein each said L-shaped terminal is integrally formed.

* * * * *